US007833111B2

(12) United States Patent
Harada

(10) Patent No.: US 7,833,111 B2
(45) Date of Patent: Nov. 16, 2010

(54) LIGHT EMITTING GOLF BALL

(75) Inventor: Shiro Harada, Koga (JP)

(73) Assignee: Lumica Corporation, Koga (JP)

( * ) Notice: Subject to any disclaimer, the term of this patent is extended or adjusted under 35 U.S.C. 154(b) by 388 days.

(21) Appl. No.: 11/914,666

(22) PCT Filed: May 18, 2005

(86) PCT No.: PCT/JP2005/009494

§ 371 (c)(1),
(2), (4) Date: Nov. 16, 2007

(87) PCT Pub. No.: WO2006/123431

PCT Pub. Date: Nov. 23, 2006

(65) Prior Publication Data

US 2009/0062033 A1 Mar. 5, 2009

(51) Int. Cl.
*A63B 37/08* (2006.01)

(52) U.S. Cl. ..... 473/353; 473/354

(58) Field of Classification Search ..... 473/353
See application file for complete search history.

(56) References Cited

U.S. PATENT DOCUMENTS 4,878,674 A * 11/1989 Newcomb et al. ..... 473/200
4,957,297 A * 9/1990 Newcomb et al. ..... 473/409
2003/0236136 A1* 12/2003 Dijkgraaf et al. ..... 473/351

(Continued)

FOREIGN PATENT DOCUMENTS

JP 60-17501 U 2/1985

(Continued)

OTHER PUBLICATIONS

International Search Report dated Jun. 28, 2005 issued in corresponding International Patent Application No. PCT/JP2005/009494.

(Continued)

*Primary Examiner*—Raeann Trimiew
(74) *Attorney, Agent, or Firm*—Westerman, Hattori, Daniels & Adrian, LLP

(57) ABSTRACT

A light-emitting golf ball is provided. The light-emitting golf ball is characterized in that hemispherical first hollow portions extend from the surface toward the center of a core, second hollow portions having a diameter less than that of the first hollow portions extend from bottom zones of the first hollow portions toward the center of the core, narrow holes extend through the core from the second hollow portions to portions of the core that are opposed to the second hollow portions, a ball body includes a transparent cover layer extending over the core surface, chemical light-emitting bodies include sealed vessels made of a flexible transparent material, the sealed vessels have cylindrical portions and round light-emitting portions having a diameter greater than that of the cylindrical portions, the cylindrical portions are tightly fit in the second hollow portions, and the light-emitting portions are fit in the first hollow portions. The light-emitting golf ball has a brightness greater than that of conventional light-emitting golf balls and therefore can be visually identified from a distance. The light-emitting golf ball can be used many times by replacing the chemical light-emitting bodies with other ones. The balance of the ball is well maintained and therefore the flying performance thereof is not deteriorated.

6 Claims, 1 Drawing Sheet

U.S. PATENT DOCUMENTS

| | | | | |
|---|---|---|---|---|
| 2007/0087862 | A1 * | 4/2007 | Redwine et al. | 473/353 |

FOREIGN PATENT DOCUMENTS

| | | | |
|---|---|---|---|
| JP | 17501 | U | 2/1985 |
| JP | 62-2974 | A | 1/1987 |
| JP | 622974 | A | 1/1987 |
| JP | 63-20863 | U | 2/1988 |
| JP | 20863 | U | 2/1988 |
| JP | 2003-077301 | A | 3/2003 |
| JP | 200377301 | A | 3/2003 |

OTHER PUBLICATIONS

International Search Report of PCT/JP2005/009494, date of mailing Jun. 28, 2005.

* cited by examiner

LIGHT EMITTING GOLF BALL

TECHNICAL FIELD

The present invention relates to balls which have a light-emitting function and which can be used for golf play at night. The present invention particularly relates to a light-emitting golf ball that is superior in luminescence to conventional light-emitting golf balls and therefore can be visually identified from a distance. The light-emitting golf ball has substantially the same flying performance as that of ordinary balls because the balance of the ball is well maintained.

BACKGROUND ART

In recent years, golf courses and baseball stadiums with lighting systems have been opened. This enables night play. In the case where an ordinary ball is used for night play, the ball can be found if the ball is in a lighted area; however, the ball cannot be readily found or is lost if the ball is in an unlighted area.

A light-emitting golf ball disclosed in Japanese Unexamined Patent Application Publication No. 62-2974 can be used for night play and is similar to one according to the present invention in that the light-emitting golf ball has a self light-emitting function. FIG. 1 of the application illustrates that the light-emitting golf ball has a structure in which a chemical light-emitting body is disposed in a cavity having an inverted triangular shape in cross section and a transparent cover covers the light-emitting body and a core disposed under the light-emitting body. The light-emitting golf ball has a disadvantage in that the illuminant cannot be replaced with another one. Since the light-emitting body is placed perpendicularly to the central axis of the core, that is, the light-emitting body is laid on the core, the length and/or diameter of the light-emitting body is limited. As disclosed in an example, the light-emitting body has a length of 20 mm, an inner diameter of 2 mm, and an outer diameter of 3 mm, that is, the light-emitting body has an extremely small inner volume and therefore can contain only a small amount of a luminescent liquid. Hence, the light-emitting body has disadvantages in that its brightness is low and its light-emitting time is short. In a step of placing the light-emitting body on the core and then forming the transparent cover, a glass vessel disposed in the light-emitting body is broken by the pressure caused by the formation of the transparent cover. This leads to product failure.

DISCLOSURE OF INVENTION

The present invention has been made to solve the above problems. It is an object of the present invention to provide a light-emitting golf ball having a brightness greater than that of conventional light-emitting golf balls. The light-emitting golf ball can be visually identified from a distance and can be used many times by replacing chemical light-emitting bodies with other ones. The balance of the ball is well maintained and therefore the flying performance thereof is not deteriorated.

In order to well maintain the balance of a core (the balance of the ball), the minimum number of first hollow portions is four. An imaginary regular triangular pyramid is formed in the core (FIG. 1) and the first hollow portions are provided at the four corners of the imaginary regular triangular pyramid. Alternatively, an imaginary cube may be formed in the core and the first hollow portions may be provided at the eight corners of the cube. This is an essential condition for well maintaining the core balance and allows the ball to have good flying performance, which is substantially equal to that of ordinary golf balls. The chemical light-emitting bodies include light-emitting portions fit in at least four of the first hollow portions; hence, any one of the light-emitting portions is visible if the ball rests at any position.

Each first hollow portion has a lower zone with a curved surface having a U-shape in cross section as shown in FIG. 2 and may have a shape suitable for allowing one of the light-emitting portions that is located at the center of first hollow portion to efficiently emit light outward. If the wall of the first hollow portion is made of a whitish material, no light-reflecting layer need to be provided on the wall thereof. If the wall is made of a material likely to absorb light, a coating is provided on the wall or aluminum is deposited on the wall by vapor deposition.

Second hollow portions extend from the centers of bottom zones of the first hollow portions toward the center of the core. The second hollow portions have a diameter slightly less than that of cylindrical portions of the chemical light-emitting bodies or are tapered such that the cylindrical portions are tightly fit in the second hollow portions. This fixes the chemical light-emitting bodies. The chemical light-emitting bodies include vessels which are flexible and which are molded from a transparent or translucent synthetic resin such as polyethylene or polypropylene by injection blowing or blow molding.

The chemical light-emitting bodies include the cylindrical portions and the light-emitting portions. The light-emitting portions have a diameter greater than that of the cylindrical portions and are substantially spherical or egg-shaped. For example, a sphere has a volume given by the formula $4/3\times\pi r^3$ ($\pi$ represents the circular constant and r represents its radius). A bar has a volume given by the formula $\pi r^2\times L$ (L represents its length). When the sphere has a diameter equal to half of the length of the bar as shown in FIG. 2, the sphere has a volume given by the formula $\pi r^2\times\frac{1}{2}\times L+4/3\times\pi(\frac{1}{2}\times L)^3$ and the bar has a volume given by the formula $\pi r^2\times L$. When the bar has a length of 20 mm and a diameter of 3 mm, the sphere has a length of 20 mm, the cylindrical portions have a diameter of 3 mm, and the sphere has a diameter of 10 mm (each has a thickness of about 0.4 mm), the bar has a volume of about 0.07 $cm^3$ and the sphere has a volume of about 0.4 $cm^3$. The liquid volume of the sphere is about five times greater than that of the bar. If the sphere has a reduced diameter or an oval spherical shape, the sphere can carry a larger amount of a luminescent liquid as compared to the bar.

Narrow holes extend from the bottoms of the second hollow portions through the core center to portions of the core that are opposed to the second hollow portions. The narrow holes are used to remove the chemical light-emitting bodies. The chemical light-emitting bodies can be removed in such a manner that thin bars are inserted into the narrow holes and the cylindrical portions are then pushed with the thin bars. The first hollow portions and the core are covered with transparent or translucent polyamide, polyurethane, polyurea, polybutadiene, or an ionomer resin by an injection molding process or a compression molding process.

In general, two types of chemicals used to induce chemiluminescence are so-called a fluorescent liquid and an oxidizing liquid. One of them is sealed in glass vessels. In view of long-term storage, it is effective that the fluorescent liquid preferably is sealed in the glass vessels because the fluorescent liquid is sensitive to moisture. The oxidizing liquid contains, for example, dimethyl phthalate, t-butanol, aqueous hydrogen peroxide, and a catalyst. The fluorescent liquid is a composition containing dibutyl phthalate, an oxalic ester, and a phosphor. In order to maintain luminescence for a long time, the oxalic ester is added to the fluorescent liquid such that the amount of the oxalic ester exceeds the solubility of dibutyl phthalate and the oxalic ester precipitates as a solid. This allows the following process to be repeated: a solid portion of the oxalic ester is dissolved therein with the progress of the reaction of the oxalic ester with hydrogen peroxide and a dissolved portion of the oxalic ester reacts with hydrogen peroxide. Hence, luminescence can be maintained. In this case, the amount of the added phosphor is sufficient to maintain luminescence for a long time. Alternatively, in order to maintain luminescence for a long time, the oxalic ester and the phosphor may be present in a solid state in the absence of solvent. This is effective in maintaining luminescence.

When being used, the chemical light-emitting bodies are bent such that the glass vessels placed therein are broken. This allows the two chemicals to be mixed with each other, resulting in the occurrence of luminescence. The light-emitting portions are pushed against the second hollow portions such that the cylindrical portions of the chemical light-emitting bodies are tightly fit in the second hollow portions. The tips of the light-emitting portions are arranged so as not to extend out of the first hollow portions. If the ball is hit with a club, players can follow the flight path of the ball or can know the flight direction of the ball. Furthermore, light can be emitted from the chemical light-emitting bodies in such a manner that a golf ball having hollow portions in which the chemical light-emitting bodies are set is prepared and an impact is applied to the golf ball by hitting the golf ball with a driver at the start.

BEST MODE FOR CARRYING OUT THE INVENTION

Figure 2:
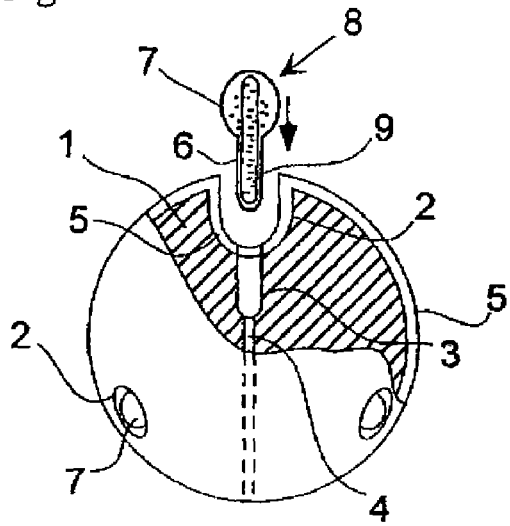
FIG. 2 is a sectional view of a light-emitting golf ball according to an embodiment of the present invention.
Figure 3:
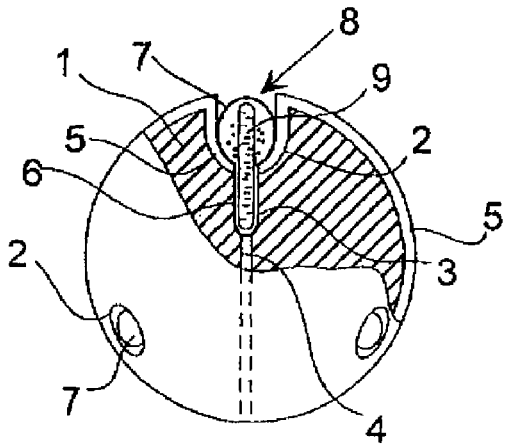
FIG. 3 is a sectional view of a light-emitting golf ball according to an embodiment of the present invention.

A light-emitting golf ball according to an embodiment of the present invention will now be described in detail with reference to the accompanying drawings. FIG. 2 shows the light-emitting golf ball of the present invention. Chemical light-emitting bodies 8 have a length of 18 mm. Cylindrical portions 6 have a diameter of 3 mm and a length of 9 mm. Light-emitting portions 7 are egg-shaped and have a maximum diameter of 8.0 mm and a length of 9 mm. Light-emitting bodies have a thickness of 0.3 to 0.4 mm and are blow-molded from polyethylene. Sealed glass tubes having a diameter of 2.2 mm, a length of 16 mm, and a thickness of 0.1 mm are placed in these vessels. The sealed glass vessels 9 contain dibutyl phthalate, bis(2,4,5-trichloro-6-carboisopentyloxyphenyl) oxalate (hereinafter referred to as CPPO), and 1-chloro-9,10-bis(phenylethynyl) anthracene dissolved in dibutyl phthalate. A portion of CPPO is present in a solid state. This mixture can be readily prepared by the following procedure: an excessive amount of CPPO is added to dibutyl phthalate such that dibutyl phthalate is supersaturated with CPPO, CPPO is then dissolved therein by heating, the solution is poured into the glass vessels, the glass vessels are sealed, and CPPO is crystallized by cooling the solution to room temperature.

An oxidizing liquid is poured into an opening of the cylindrical portion 6 of each vessel, which has the above size and is blow-molded, one of the sealed glass vessels 9 is placed thereinto, and the opening is then closed, whereby each chemical light-emitting body 8 is completed.

Figure 1:
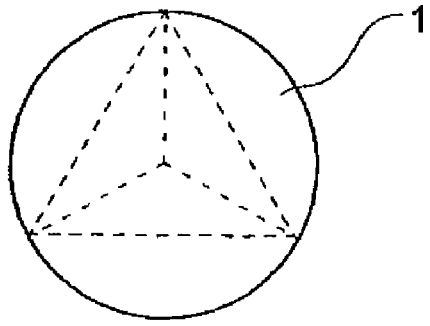
FIG. 1 is an illustration showing positions for forming first hollow portions in a core according to an embodiment of the present invention.

An imaginary regular triangular pyramid is formed in a white core 1 which has a diameter of about 40 mm and which is made of butadiene rubber (FIG. 1). Four first hollow portions 2 which have a diameter of 10 mm and a depth of 11 mm and which have substantially a hemispherical shape are formed at the four corners of the imaginary regular triangular pyramid. This allows the first hollow portions 2 to be arranged at equal intervals. The core is covered with a transparent ionomer resin 5. This is performed by injection molding.

Holes having a diameter of 8.0 mm and a depth of 10 mm are formed with a ball end mill so as to extend from the centers of transparent resin layers disposed in the first hollow portions 2 toward the center of the core, whereby a transparent layer 5 with a thickness of 1 mm is formed over the walls of the first hollow portions 2. Second hollow portions 3 having a diameter of 2.98 mm and a depth of 9 mm are formed at the centers of bottom zones of the second hollow portions so as to extend toward the center of the ball. Narrow holes 4 are bored through the ball so as to extend from the bottom zone centers of the second hollow portions to portions of the ball that are opposed to the bottom zone centers thereof. The chemical light-emitting bodies 8 allowed to emit light in advance are pushed into the four first hollow portions 2 of the golf ball prepared as described above. The light emitted from each light-emitting portion 7 containing a sufficient amount of liquid is reflected by the inner wall of the white core 1 and is then emitted outside, whereby intense light is obtained. In this embodiment, since the transparent cover layer 5 covers the light-emitting portions 7, it is characteristic that the light-emitting area is large. If the transparent cover layer 5 is not formed over the walls of the first hollow portions 2, the nighttime visibility is not problematic.

INDUSTRIAL APPLICABILITY

According to the present invention, the light-emitting portions are arranged in the ball, which has substantially the same configuration as that of an ordinary ball, in a balanced manner as described above; hence, the flying performance is not deteriorated. The amount of a luminescent liquid is sufficient to enhance the brightness and the light-emitting time as compared to conventional light-emitting golf balls. The light emitted from the luminescent liquid is reflected outward by a reflective surface. The ball has high light-emitting efficiency. Therefore, the ball can be visually identified from a considerable distance when the ball is in an unlighted, dark area or is in flight.

The invention claimed is:

1. A light-emitting golf ball comprising:

a ball body comprising a core and a cover layer extending over the core, wherein the ball body has first hollow portions extending from the surface of the ball body toward the center of the core, the first hollow portions being arranged at equal intervals in the surface of the ball body, second hollow portions having a diameter less than that of the first hollow portions, the second hollow portions extending from bottom zones of the first hollow portions toward the center of the core, and narrow holes extending through the core from the second hollow portions to portions of the core that are opposed to the second hollow portions; and chemical light-emitting bodies detachably fixed in the first hollow portions and the second hollow portions, each of chemical light-emitting bodies comprising a sealed vessel made of a flexible transparent material having cylindrical portion and a round light-emitting portion with a diameter greater than that of the cylindrical portion and filled with a first chemical that exhibits chemiluminescence, and sealed glass vessels accommodated in the sealed vessels filled with a second chemical which exhibits chemiluminescence when being mixed with the first chemical, wherein the cylindrical portions are tightly fit in the second hollow portions, and the light-emitting portions are fit in the first hollow portions.

2. A light-emitting golf ball comprising:

a ball body comprising a core and a cover layer extending over the core, wherein the ball body has hemispherical first hollow portions extending from the surface of the ball body toward the center of a core and are arranged at equal intervals in the surface of the ball body, second hollow portions having a diameter less than that of the first hollow portions, second hollow portions extending from bottom zones of the first hollow portions toward the center of the core, narrow holes extending through the core from the second hollow portions to portions of the core that are opposed to the second hollow portions, wherein the ball body includes a transparent or translucent cover layer extending over the core surface and surfaces of the first hollow portions, chemical light-emitting bodies include detachably fixed in the first hollow portions and the second hollow portions, each of chemical light-emitting bodies comprising sealed vessels made of a flexible transparent material having cylindrical portion and a round light-emitting portion with a diameter greater than that of the cylindrical portion and filled with a first chemical that exhibits chemiluminescence, and sealed glass vessels accommodated in the sealed vessels filled with a second chemical which exhibits chemiluminescence when being mixed with the first chemical, wherein the cylindrical portion is tightly fit in the second hollow portions, and the light-emitting portion is fit in the first hollow portions.

3. The light-emitting golf ball according to claim 1 or 2, wherein the walls of the first hollow portions are overlaid with light-reflecting layers.

4. The light-emitting golf ball according to claim 1 or 2, wherein the core is molded from a white material or a whitish material.

5. The light-emitting golf ball according to claim 1 or 2, wherein the second chemical enclosed in the sealed glass vessels comprises: a solvent, an oxalic ester, and a phosphor, wherein one portion of the oxalic ester and the phosphor are dissolved in the solvent, and the other portion of the oxalic ester is present in a solid form such as a powder form or a crystalline form; and wherein the first chemical which is placed outside the sealed glass vessels and which is contained in the sealed vessels is an oxidizing liquid.

6. The light-emitting golf ball according to claim 1 or 2, wherein the second chemical enclosed in the sealed glass vessels contains no solvent but an oxalic ester and a phosphor;

the oxalic ester and the phosphor are present in a solid form such as a powder form or a crystalline form; and the first chemical which is placed outside the glass vessels and which is contained in the vessels is an oxidizing liquid.

* * * * *